US007810267B2

(12) United States Patent
Saint et al.

(10) Patent No.: US 7,810,267 B2
(45) Date of Patent: Oct. 12, 2010

(54) PATIENT IDENTIFICATION PRODUCTS

(75) Inventors: Andre M. Saint, Getzville, NY (US); Stanley J. Serwon, Newstead, NY (US); Rosalyn R. Ben-Chitrit, Woodbridge, CT (US); Anne Runfola, Williamsville, NY (US)

(73) Assignee: Avery Dennison Corporation, Pasadena, CA (US)

( * ) Notice: Subject to any disclaimer, the term of this patent is extended or adjusted under 35 U.S.C. 154(b) by 946 days.

(21) Appl. No.: 11/111,539

(22) Filed: Apr. 21, 2005

(65) Prior Publication Data

US 2006/0236578 A1 Oct. 26, 2006

(51) Int. Cl.
*A44C 5/00* (2006.01)

(52) U.S. Cl. ..... 40/633; 340/573.4; 340/572.8

(58) Field of Classification Search ..... 40/633; 428/40.1, 42.1, 42.2, 43, 195.1
See application file for complete search history.

(56) References Cited

U.S. PATENT DOCUMENTS

| | | | | | |
|---|---|---|---|---|---|
| 2,561,894 | A | * | 7/1951 | Wallich | 40/633 |
| 3,751,835 | A | * | 8/1973 | Smith | 40/633 |
| 4,548,845 | A | | 10/1985 | Parsons et al. | |
| 4,682,431 | A | * | 7/1987 | Kowalchuk | 40/633 |
| 4,991,337 | A | * | 2/1991 | Solon | 40/633 |
| 5,262,216 | A | | 11/1993 | Popat et al. | |
| 5,311,689 | A | * | 5/1994 | Lindsey | 40/633 |
| 5,393,264 | A | | 2/1995 | Kraft et al. | |
| 5,405,475 | A | | 4/1995 | Kraft et al. | |
| 5,560,657 | A | | 10/1996 | Morgan | |
| 5,580,640 | A | | 12/1996 | Kraft et al. | |
| 5,653,472 | A | | 8/1997 | Huddleston et al. | |
| 5,773,386 | A | | 6/1998 | Langan | |
| 5,933,993 | A | | 8/1999 | Riley | |
| 5,973,598 | A | | 10/1999 | Beigel | |
| 5,973,600 | A | | 10/1999 | Mosher, Jr. | |
| 6,000,160 | A | | 12/1999 | Riley | |
| 6,016,618 | A | * | 1/2000 | Attia et al. | 40/633 |
| 6,067,739 | A | | 5/2000 | Riley | |
| 6,104,295 | A | | 8/2000 | Gaisser et al. | |
| 6,124,236 | A | | 9/2000 | Mitchell | |
| 6,181,287 | B1 | | 1/2001 | Beigel | |

(Continued)

FOREIGN PATENT DOCUMENTS

EP 0071933 A1 2/1983

(Continued)

OTHER PUBLICATIONS

Improvement in Transfusion Safety Using a Specially Designed Transfusion Wristband; F.Y. Lau et al.; Transfusion Medicine, 2000, vol. 10, pp. 121-124; Feb. 2, 2000.

(Continued)

*Primary Examiner*—Lesley Morris
*Assistant Examiner*—Shin Kim
(74) *Attorney, Agent, or Firm*—Patent Group Law Department

(57) ABSTRACT

An identification band is formed from a soft flexible woven fabric, such as polyester or nylon. The identification band includes a front surface and a back surface. Patient specific indicia can be imprinted on selected areas of the front surface. The identification band initially is part of a laminated sheet that can be processed through a printing apparatus.

22 Claims, 7 Drawing Sheets

U.S. PATENT DOCUMENTS

| | | | | |
|---|---|---|---|---|
| 6,186,554 | B1 | 2/2001 | Raming | |
| 6,211,790 | B1 | 4/2001 | Radomsky et al. | |
| 6,213,518 | B1 | 4/2001 | Raming | |
| 6,340,512 | B1 | 1/2002 | Mercer et al. | |
| 6,368,688 | B1 | 4/2002 | Crum et al. | |
| 6,438,881 | B1 | 8/2002 | Riley | |
| 6,455,299 | B1 | 9/2002 | Steinman et al. | |
| 6,510,634 | B1 | 1/2003 | Riley | |
| 6,608,002 | B1 | 8/2003 | Mitchell | |
| 6,641,048 | B1 | 11/2003 | Schintz et al. | |
| 6,685,228 | B2 | 2/2004 | Riley | |
| 6,698,116 | B2 | 3/2004 | Waldron | |
| 6,743,493 | B2 | 6/2004 | Crum et al. | |
| 6,748,687 | B2 | 6/2004 | Riley | |
| 6,773,181 | B2 | 8/2004 | Crum | |
| 6,830,795 | B1 | 12/2004 | Downs | |
| 6,836,215 | B1 | 12/2004 | Laurash et al. | |
| 6,863,311 | B2 | 3/2005 | Riley | |
| 6,884,491 | B2 | 4/2005 | Rubin et al. | |
| 6,924,688 | B1 | 8/2005 | Beigel | |
| 7,017,293 | B2 * | 3/2006 | Riley | 40/633 |
| 7,017,294 | B2 * | 3/2006 | Riley | 40/633 |
| 7,047,682 | B2 | 5/2006 | Riley | |
| 7,094,732 | B2 | 8/2006 | Finger | |
| 7,181,878 | B2 * | 2/2007 | Tucker | 40/638 |
| 7,222,448 | B2 | 5/2007 | Riley | |
| 7,268,680 | B2 | 9/2007 | Gary | |
| 2003/0001381 | A1 | 1/2003 | Riley | |
| 2003/0016122 | A1 * | 1/2003 | Petrick | 340/10.41 |
| 2003/0049403 | A1 | 3/2003 | Crum et al. | |
| 2003/0049404 | A1 | 3/2003 | Mercer et al. | |
| 2003/0218329 | A1 | 11/2003 | Buck | |
| 2003/0220036 | A1 | 11/2003 | Lee et al. | |
| 2004/0001931 | A1 | 1/2004 | Izzi et al. | |
| 2004/0060215 | A1 | 4/2004 | Riley | |
| 2004/0060216 | A1 * | 4/2004 | Riley | 40/633 |
| 2004/0068906 | A1 | 4/2004 | Riley | |
| 2004/0077388 | A1 | 4/2004 | Crum | |
| 2004/0088228 | A1 | 5/2004 | Mercer et al. | |
| 2004/0090061 | A1 | 5/2004 | Crum | |
| 2004/0091299 | A1 | 5/2004 | Crum | |
| 2004/0148836 | A1 | 8/2004 | Riley | |
| 2004/0211512 | A1 | 10/2004 | Crum | |
| 2004/0237366 | A1 | 12/2004 | Chadwick et al. | |
| 2004/0244251 | A1 | 12/2004 | Riley | |
| 2004/0247366 | A1 | 12/2004 | Crum | |
| 2004/0252321 | A1 | 12/2004 | Buck et al. | |
| 2005/0040226 | A1 * | 2/2005 | Al-Sheikh | 235/380 |
| 2005/0046176 | A1 | 3/2005 | Crum | |
| 2005/0057038 | A1 | 3/2005 | Crum | |
| 2005/0058811 | A1 | 3/2005 | Crum | |
| 2005/0058814 | A1 | 3/2005 | Crum | |
| 2005/0058828 | A1 | 3/2005 | Crum | |
| 2005/0075152 | A1 | 4/2005 | Buck et al. | |
| 2005/0081415 | A1 | 4/2005 | Mark | |
| 2005/0087976 | A1 | 4/2005 | Crum | |
| 2005/0087977 | A1 | 4/2005 | Crum | |
| 2005/0087978 | A1 | 4/2005 | Tucker | |
| 2005/0091896 | A1 | 5/2005 | Kotik et al. | |
| 2005/0106364 | A1 | 5/2005 | Crum | |
| 2005/0106747 | A1 | 5/2005 | Chaoui et al. | |
| 2005/0108912 | A1 | 5/2005 | Bekker | |
| 2005/0109824 | A1 | 5/2005 | Allee | |
| 2005/0120291 | A1 | 6/2005 | Guilfoyle et al. | |
| 2005/0127148 | A1 | 6/2005 | Gecha | |
| 2005/0133576 | A1 | 6/2005 | Maier et al. | |
| 2005/0156017 | A1 | 7/2005 | Crum et al. | |
| 2005/0163980 | A1 | 7/2005 | Crum | |
| 2005/0166035 | A1 | 7/2005 | Crum | |
| 2005/0166436 | A1 | 8/2005 | Girvin et al. | |
| 2005/0167973 | A1 | 8/2005 | Crum | |
| 2005/0179255 | A1 | 8/2005 | Olson | |
| 2005/0279001 | A1 | 12/2005 | Riley | |
| 2006/0059753 | A1 | 3/2006 | Riley et al. | |
| 2007/0220796 | A1 | 9/2007 | Riley et al. | |

FOREIGN PATENT DOCUMENTS

| | | | |
|---|---|---|---|
| GB | 1600641 | | 10/1981 |
| GB | 2228916 | | 9/1990 |
| JP | 2004298443 | A | 10/2004 |
| JP | 2006118074 | A | 5/2006 |
| WO | 9205036 | A1 | 4/1992 |
| WO | WO 98/40867 | | 9/1998 |
| WO | WO 98/40930 | | 9/1998 |
| WO | WO 99/13441 | | 3/1999 |
| WO | WO 99/13444 | | 3/1999 |
| WO | WO 00/26856 | | 5/2000 |
| WO | WO 01/99088 | | 12/2001 |
| WO | 0224018 | A1 | 3/2002 |
| WO | WO 02/39412 | A2 | 5/2002 |
| WO | 02/084630 | | 10/2002 |
| WO | WO 03/003331 | A2 | 1/2003 |
| WO | WO 03/009224 | A1 | 1/2003 |
| WO | 2004030921 | A2 | 4/2004 |
| WO | 2004030922 | A1 | 4/2004 |
| WO | WO 2004/028826 | A2 | 4/2004 |
| WO | WO 2005/038631 | A2 | 4/2005 |
| WO | WO 2005/045742 | A2 | 5/2005 |
| WO | 2005064574 | A1 | 7/2005 |

OTHER PUBLICATIONS

Office action dated Feb. 20, 2009 from corresponding Chinese Application No. 200680018743.5.

Response dated Jun. 26, 2009 from corresponding Chinese Application No. 200680018743.5.

* cited by examiner

PATIENT IDENTIFICATION PRODUCTS

BACKGROUND OF THE INVENTION

1. Field of the Invention

The invention relates to patient identification products, including wristbands, anklebands, identification cards and labels.

2. Description of the Related Art

Hospitals and other healthcare facilities are acutely aware of problems associated with improper identification and tracking of patients. These concerns extend to carefully and correctly identifying specimens taken from a patient for analysis and carefully matching medicine for administration to a patient. With infants, the concerns also extend to properly matching parents with the correct infant.

Identification bands for the wrist and/or ankle typically are applied to a patient as part of the hospital admission process. The typical identification band is imprinted with the name of the patient and other relevant data, and sometimes is imprinted with a machine readable barcode. The barcode and at least some of the other data on the identification bracelet also may be imprinted on labels that are used periodically through the patient's stay in a healthcare facility. For example, a label can be applied to a documentation that goes into a chart that is associated with the patient's care. Labels may be applied to specimen collection tubes and the results of diagnostic tests performed on collected specimens will be routed physically or electronically based on data imprinted on the labels. Doses of medication typically are prepared by medical or pharmacy personnel and may be placed in containers that bear labels with barcodes. The healthcare provider may carry a barcode reader and will scan both the medicine container and the patient's identification band prior to administering a drug to ensure conformance. The patient's identification band also will be checked visually or by machine before performing any medical procedure.

The information printed on a patient's identification band and information printed on labels associated with the patient's identification band typically is stored in the memory of a computer. The patient's identification band and labels associated with the identification band are printed by a printer associated with the computer. The printer may be an inkjet printer, a laser printer or the like. Accordingly, the identification bands should be formed in a manner that will ensure efficient processing through a printer.

Identification bands and other identification material employed in a healthcare facility may be exposed to liquids and may be subjected to physical contact. The printed information must remain readable despite periodic moistening and contact. Accordingly, some identification bands are laminated structures with a clear plastic overlay secured on a substrate that bears the printed indicia. Laminated identification bands may require complex, time consuming manipulation by the healthcare worker.

Some patients remain in a healthcare facility for an extended time, and many of these patients have sensitive skin. For example, prematurely born infants may spend several weeks or months in a healthcare facility while they are being monitored, nourished and treated. A significant portion of this stay could be in a neonatal intensive care unit (NICU). These small babies often are visually indistinguishable from one another and are incapable of identifying themselves. Additionally, infants in a neonatal intensive care unit may have a specified regimen of nourishment and medication requirements based on their own individual fragile conditions. Accordingly, proper identification is essential. However, conventional identification bands are fairly rigid due to the thickness and stiffness of the materials and can easily irritate the skin of a small baby. Skin irritations or abrasions may require treatment and can complicate the extended stay of a premature baby in the neonatal intensive care unit. A similar problem can arise with elderly patients who may be required to stay an extended time in a healthcare facility.

Healthcare facilities also are concerned with security in and around the maternity ward and the neonatal care units. Accordingly, many hospitals require the parents to wear wristbands corresponding to the identification band worn by the baby. These parental wristbands place controls on the number and identity of people to whom the baby will be exposed and address security concerns of the healthcare facility. The parental wristbands desirably are printed automatically from the information stored in the computer and most preferably are printed simultaneously with identification band of the infant. As RFID technology grows and becomes mainstream, the use of this technology within an identification band creates the ability to track location or movement of patients within a facility, as well as enable dynamic collection and storage of other relevant information, increasing security.

In view of the above, it is an object of the invention to provide an identification band that can be worn comfortably by a patient for an extended time.

It is another object of the invention to provide an identification band that is well suited for infants, and particularly prematurely born infants, and elderly patients.

A further object of the invention is to provide an identification band that can withstand exposure to moisture and contact without affecting the ability to read, via RF, optical scan, or the like, the information presented thereon.

Still another object is to provide an identification assembly for simultaneously printing several identification tools including at least one wristband or ankleband.

Yet a further object of the invention is to provide an identification band that can be applied and used easily by healthcare workers.

SUMMARY OF THE INVENTION

The invention relates to an identification band suitable for carrying and displaying indicia and suitable for being worn on the wrist or ankle of an infant or other person. The identification band is formed from a thin flexible layer of woven material, and preferably is formed from a material that will permanently and clearly display indicia imparted thereon by a commercially available printer, such as a laser printer, inkjet printer, thermal printer or the like. The woven material preferably is a woven synthetic fabric, such as polyester or nylon. Additionally, the woven fabric may be impregnated with a compatible synthetic material that will substantially fill voids between the woven fibers of the fabric to define a sufficiently continuous and smooth surface for receiving and displaying printed indicia. The synthetic material impregnated into the woven fabric may be a polyester, styrene, acrylic or other compatible organic-based material. The identification band in accordance with the invention preferably is sufficiently thin and flexible to avoid irritating sensitive skin. For example, a sheet material with a thickness of about 3.0-6.0 mils is preferred, and most preferably the material has a thickness of about 4.0 mils.

Identification bands in accordance with the subject invention are particularly well suited for infants, children and especially for prematurely born infants who will remain in a healthcare facility for several days, weeks or months. Narrow width bands are especially well suited for the small wrists or ankles of infants. However, a narrow band may not have sufficient dimensions for receiving all of the identification information that is required. As a result, the identification band includes a narrow strap and an identification panel. The strap is sufficiently wide to provide the necessary strength and to prevent biting into the wrist or ankle of the patient. Additionally, the strap preferably is wide enough to prevent twisting during normal use. A strap of approximately 1 cm wide is sufficient for these purposes. The identification panel is sufficiently wide and long to accommodate the identification indicia that may be required. For example, an identification panel with a width of about 2-3 cm and a length of about 5 cm is sufficiently large to convey the required indicia with adequate size and clarity. The identification panel preferably is unitary with one longitudinal end of the strap, and preferably is free of sharp corners. The identification panel includes a top surface on which the identification indicia may be printed and an opposite back surface. The back surface need not be printed with identification indicia.

The identification band may further include a flap joined unitarily to the identification panel along a connection line that preferably is substantially parallel to the longitudinal direction of the strap. The flap preferably is the same size and shape as the identification panel and has opposite top and back surfaces. The top surface of the flap may be printed with the same or additional identification indicia as the top surface of the identification panel.

A layer of pressure sensitive adhesive is applied to the back surface of the flap and/or the back surface of the identification panel. With this construction, the strap can be formed into a loop so that a section of the strap is placed in face-to-face engagement with the back surface of the identification panel. The flap then is folded so that the back surface of the flap overlies the back surface of the identification panel and sandwiches a portion of the strap between the back surfaces of the identification panel and the flap. The adhesive applied to the back surface of the flap and/or the identification panel will securely retain the strap in its looped condition to form a continuous identification band. Although the strap is appropriately narrow for an infant, the identification panel is sufficiently large to bear the required identification indicia. Additionally, identification indicia on the flap will ensure that the identification data are easily readable even if the identification band becomes twisted slightly while worn. RFID HF or UHF inlay (such as Texas instruments Tag it or Avery Dennison's UHF) may also be inserted during manufacturing to reside between the laminate layers or separate from band of which the inlay label would be affixed prior to folding, thereby securing the inlay safely, securely and permanently between or on topside of the folds. In addition, the compressible nature of the woven fabric provides a protective cushion around the RFID to help it resist damage and can be made waterproof to further protect the identification band or RFID inlay as well.

An important aspect of the invention is the ability to print the identification band efficiently and reliably in a laser printer, thermal, an inkjet printer or other commercially available printing apparatus. Printers work best when the printed sheets are relatively thin and have uniform thickness or coplanarity across the length and width of the sheet. Sheets that are too thick may not feed well in many machines and sheets that do not exhibit coplanarity across the sheet are likely to jam in the feed mechanisms of the printer.

The identification band of the subject invention preferably is part of a laminated sheet assembly that includes a face sheet and a backing sheet. The face sheet is formed from the above-described sheet of woven fibers, such as polyester or nylon. The face sheet has a top surface on which the indicia is imprinted and a back surface that requires no indicia. The backing sheet may be formed from a paper material with opposite top and back surfaces. The top surface of the backing sheet is secured at least temporarily in face-to-face engagement with the back surface of the face sheet.

The face sheet is provided with at least one array of die cuts to define the preferred shape for the identification band. The die cuts are dimensioned to hold the identification band as part of the entire face sheet as the laminated sheet assembly is being processed through a printer.

A major part of the back surface of the face sheet may have a thin coat of pressure sensitive adhesive applied thereto. However, there preferably is no adhesive applied to portions of the back surface of the face sheet that will define the strap of the identification band. The top surface of the backing sheet preferably has a thin release coat applied to portions of the backing sheet that will register with the identification panel and flap of the identification band. However, the release coat preferably is disposed at locations spaced inwardly from the outer periphery of the backing sheet. The backing sheet further includes an array of low tack adhesive, breakaway or dry release coatings on portions of the top surface of the backing sheet that will register with the strap of the identification band. The low tack adhesive will hold the strap of the identification band releasably to the backing sheet as the laminated sheet assembly is being processed through a printer. However, the strap can be separated easily from the low tack adhesive, breakaway or dry release coatings and the low tack adhesive or the like will not be transferred to the strap.

The laminated sheet assembly may include an indicia bearing card that can be slid into or affixed utilizing a removable pressure sensitive adhesive a mounting frame on a crib, isolette, basinet, bed or the like to identify the patient and/or his/her treatment area. Portions of the back surface of the face sheet corresponding to an identification card may have the pressure sensitive adhesive applied thereto and the opposed top surface of the backing sheet preferably has no release coating and no low tack adhesive breakaway or dry release coatings applied thereto. Hence, the identification card defined by the face sheet will be secured substantially permanently to corresponding portions of the backing sheet for added structural support and integrity. Embodiments that have an identification card preferably have die cuts that extend through both the face sheet and the backing sheet around the periphery of the identification card.

The laminated sheet assembly may further define at least one adhesive backed label that may be applied to a bottle of milk or formula. The label is defined by an array of die cuts in the face sheet. Patient-identifying indicia may be printed on the top surface of the face sheet within the area bounded by the array of die cuts that define the label. A pressure sensitive adhesive is applied to portions of the back surface of the face sheet corresponding to the label. A release coat preferably is applied to the top surface of the backing sheet opposed to the label. With this construction, the label can be removed along the die cuts from the remainder of the face sheet and peeled from the backing sheet. The label then can be secured to a substrate, such as a bottle.

DETAILED DESCRIPTION OF THE PREFERRED EMBODIMENTS

Figure 1:
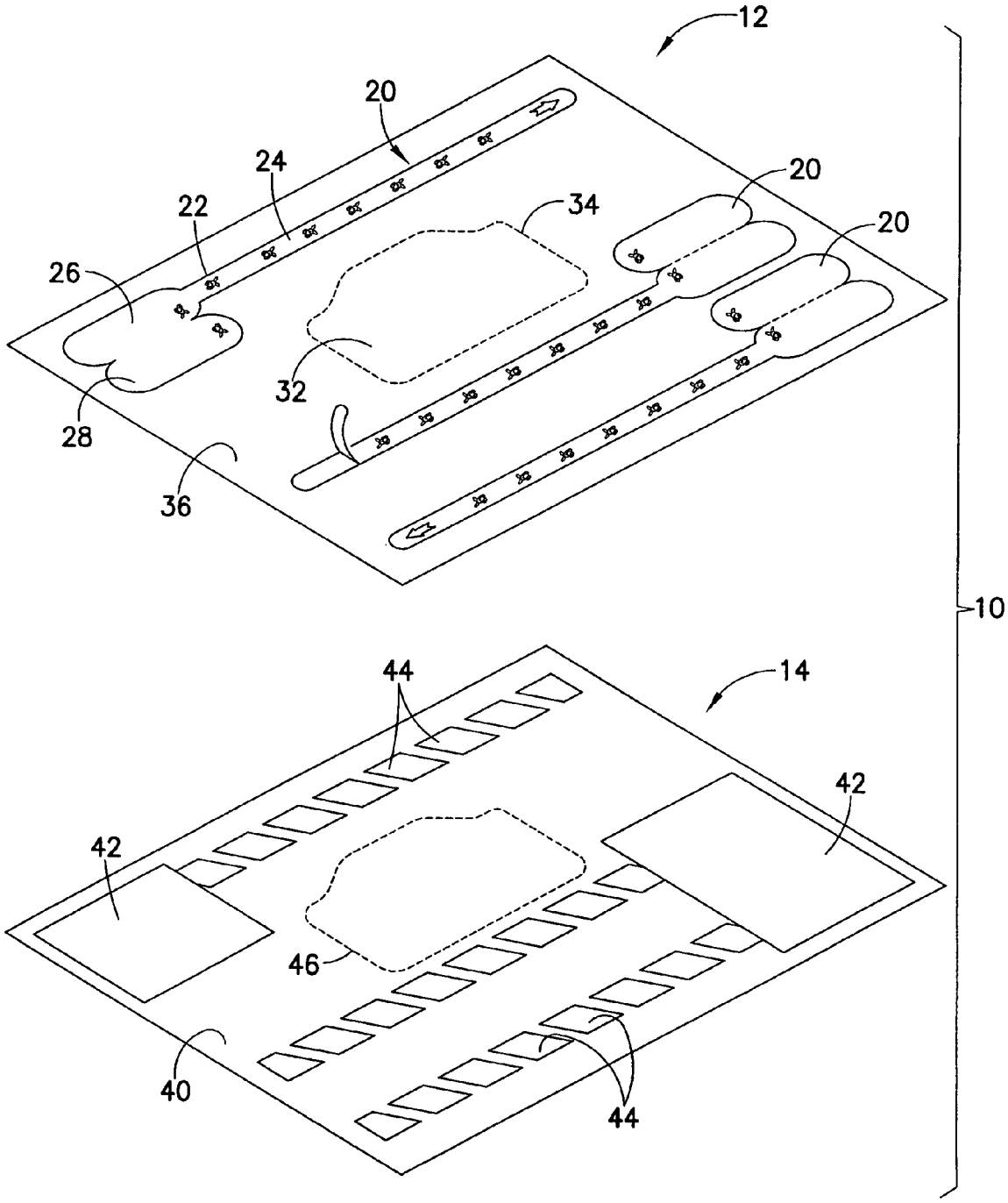
FIG. 1 is an exploded perspective view of a laminated sheet assembly in accordance with the invention.

A sheet assembly in accordance with the subject invention is identified generally by the numeral 10 in FIG. 1. The sheet assembly 10 includes a face sheet 12 and a backing sheet 14. The face sheet 12 is substantially rectangular and preferably is formed from a woven material, such as polyester, that has been impregnated with a compatible filler, such as polyester or nylon. The filler is applied sufficiently to define a relatively smooth continuous surface that will accept and retain printed indicia. The face sheet 12 preferably defines a thickness of about 5 mils.

A plurality of identification bands 20 are defined on the face sheet 12 by a corresponding plurality of arrays of die cuts 22. The die cut arrays 22 may be die cut, laser cut or otherwise formed to extend through the face sheet 12 at a plurality of spaced apart locations thereon. The specific dimensions of the die cut arrays may vary depending upon the characteristics of the woven material from which the face sheet 12 is formed. However, the die cut arrays 22 should be formed to permit separation of the identification bands 20 from the face sheet 12 without excessive manipulation or force and without tearing either the identification bands 20 or adjacent areas of the face sheet 12. In a preferred embodiment, each die cut is a continuous die cut around the complete perimeter of all bands, cards or labels. The length of each die cut and the lengths of the ties between die cuts will vary in accordance with the characteristics of the material from which the face sheet 12 is formed.

Each identification band 20 includes a strap 24, an identification panel 26 and a flap 28. The strap 24 has a width of about 1.0 cm and length of about 18-24 cm. The identification panel 26 is generally an ellipse or oblong with rounded corners defining a radius of about 0.75-1.50 cm. The rounded corners are not likely to irritate skin and minimize the risk of tearing when the identification band 20 is being separated from the remainder of the face sheet 12. The identification panel 26 is sufficiently large to display the required information. A preferred identification panel has a length of about 5.0 cm and a width of about 2.0-3.0 cm. The strap 24 extends substantially symmetrically from a narrow end of the identification panel 26. The flap 28 is joined unitarily to the identification panel 26 along a fold line 30 that is aligned substantially parallel to the longitudinal direction of the strap 24. The fold line 30 is shorter than the identification panel 26 and the flap 28 and terminates at well defined concave cusps to facilitate precise folding.

The face sheet 12 of the illustrated embodiment further includes an identification card 32 formed by an array of die cuts 34. The identification card 32 is generally rectangular, but includes a tab extending from one long side thereof.

Figure 2:
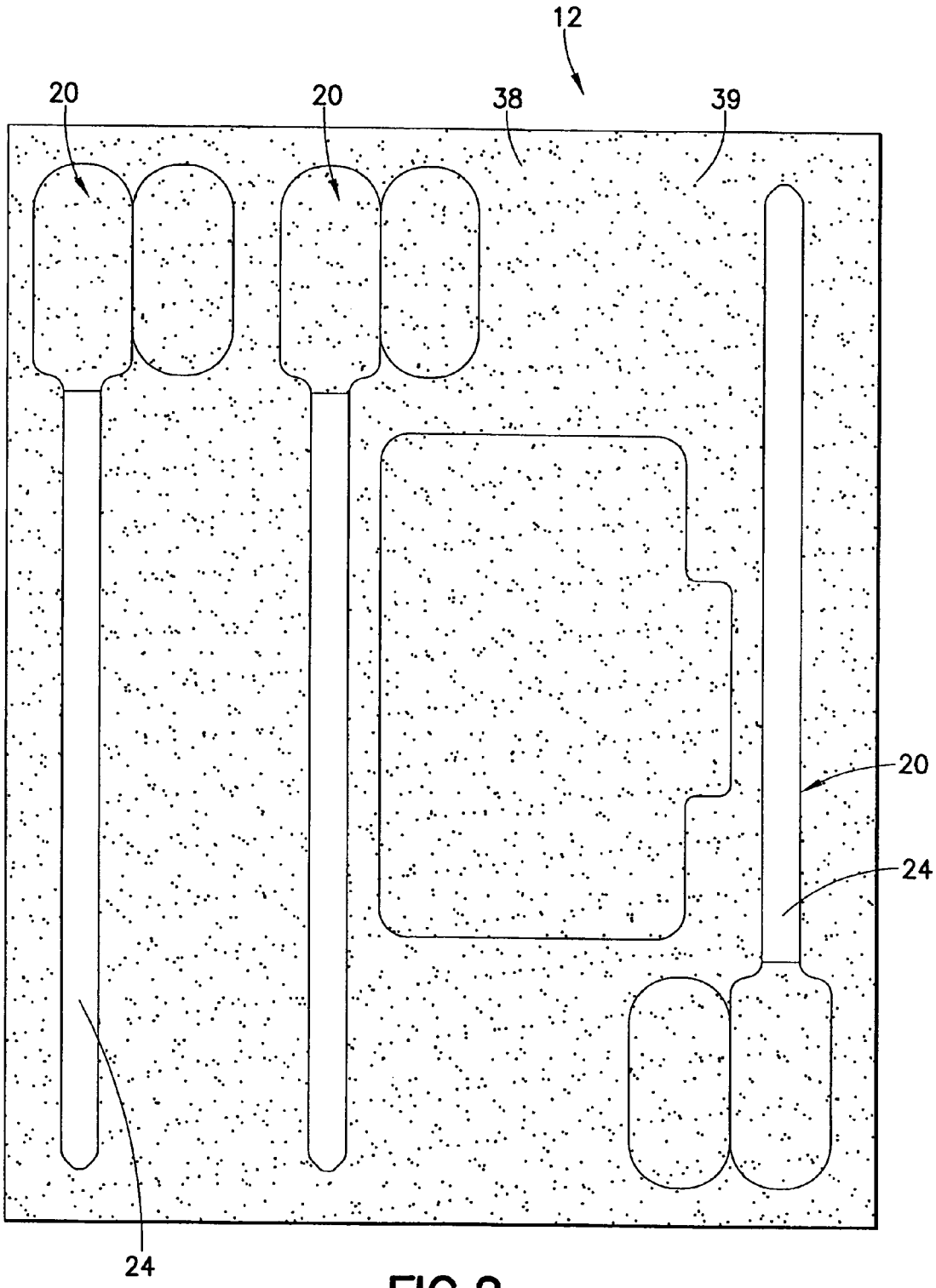
FIG. 2 is a bottom plan view of the face sheet shown in FIG. 1.

The face sheet 12 includes a top surface 36 as shown in FIG. 1 and an opposite back surface 38 as shown in FIG. 2. The top surface 36 of the face sheet 12 is imprinted with patient-specific indicia at locations corresponding to the identification panel 26, the flap 28 and the identification card 32.

The back surface 38 of the face sheet 12 is provided with a thin layer of adhesive 39 applied to substantially all regions of the back surface 38 except for areas of the back surface 38 within portions of the die cut array 22 that define the strap 24 of the identification band 20. The pressure sensitive adhesive 39 has a composition that will remain stable and not flow when subjected to temperatures as high as 300° F. to 400° F. to facilitate printing of the sheet assembly 10 in a laser printer or other high temperature printing apparatus. The adhesive 39 also should not degrade easily when exposed to ultra-violet light. In this regard, exposure to ultra-violet light during normal use of the components of the sheet assembly 10 should not turn the adhesive yellow or cause the adhesive to lose its tackiness. One such adhesive is described in U.S. Pat. No. 5,262,216, the disclosure of which is incorporated herein by reference. A preferred adhesive is the P32 hot melt adhesive which is available from Avery Dennison Corporation. The pressure sensitive adhesive 39 typically will have a thickness in the range of about 0.25 to 2.0 mils.

Figure 3:
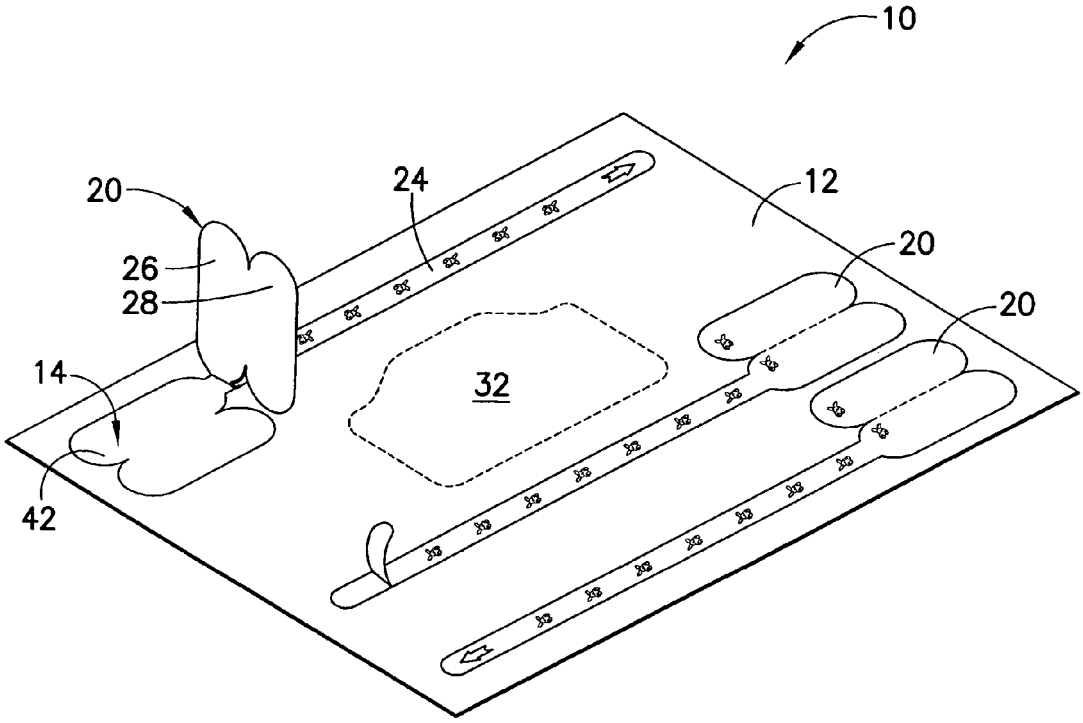
FIG. 3 is a perspective view of the sheet assembly showing the identification band in the process of being removed.
Figure 4:
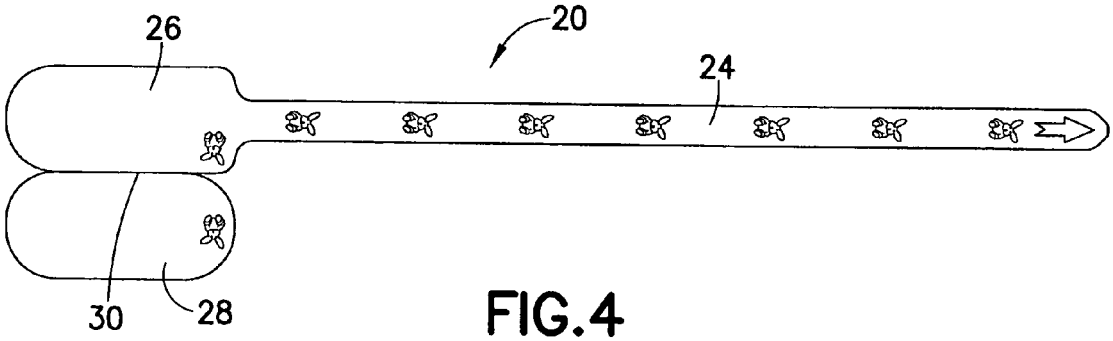
FIG. 4 is a top plan view of the identification band prior to being formed into a loop.
Figure 5:
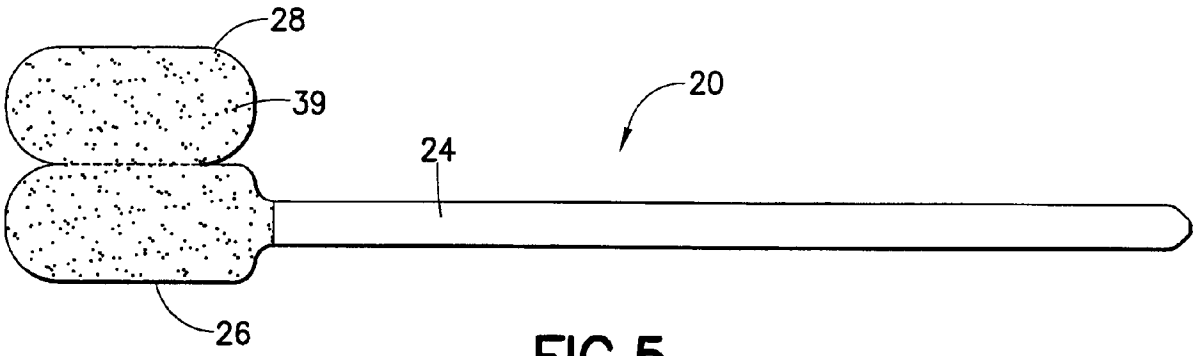
FIG. 5 is a bottom plan view of the identification band in the planar orientation shown in FIG. 4.

The backing sheet 14 is substantially rectangular and conforms to the size and shape of the face sheet 12. The backing sheet 14 can be any flexible paper or film. Preferably, however, the backing sheet 14 is a paper sheet with a thickness selected so that the sheet assembly 10 can be processed efficiently through a conventional sheet-fed printer, such as a laser printer or ink jet printer. Currently available printers can process sheets with a thickness of 15 mils or less. A backing sheet with a thickness of 2 to 6 mil would provide sufficient support for the sheet assembly 10 while still permitting efficient processing through a conventional printing apparatus. The backing sheet 14 has a top surface 40 as shown in FIGS. 1 and 3 and an opposite back surface (not shown). A release coating 42 is applied to areas of the top surface 40 of the backing sheet 14 that will register with the identification panel 26 and the flap 28. The release coating preferably is a conventional silicone composition, but other release compositions, such as fluorinated or amine-based release compositions can be used. The release coating 42 can be extremely thin, e.g., in the range of about 0.1 to 0.5 mils. Additionally, a low tack adhesive, breakaway or clean release 44 is applied to areas of the top surface 40 of the backing sheet 14 that will register with the strap 24 of the identification band 20. The low tack adhesive 44 may extend continuously in opposed relationship to the strap 24. However, in the illustrated embodiment, the low tack adhesive 44 is applied at locations spaced from one another along the length of the strap 24. The dimensions of each discrete region of low tack adhesive 44 on the top surface 40 of the backing sheet 14 exceed the dimensions of the spacing between the sections of low tack adhesive 44. The spacing is selected to ensure that the strap 24 will be retained on the backing sheet 14 as the assembly 10 is being processed through a printer. However, the extent and characteristics of the low tack adhesive breakaway or clean release areas 44 should not lead to difficulties in separating the strap 24 from the backing sheet 14. Additionally, the spacing between the areas 44 of low tack adhesive breakaway or clean release should not create significant surface discontinuities across the laminated sheet 10 in a way that could affect the coplanarity of the laminated sheet 10. Areas of the top surface 40 of the backing sheet 14 spaced from the identification band 20 have no release coating 42 and no low tack adhesive breakaway or clean release 44.

The backing sheet 14 further includes an array of die cuts 46 that will substantially register with the die cuts 34 that define the identification card 32. Thus, the die cuts 46 on the backing sheet 14 define an identification card support conforming to the size and shape of the identification card 32.

The back surface 38 of the face sheet 12 can be registered with and secured to the top surface 40 of the backing sheet 14 to form the sheet assembly 10. The sheet assembly 10 then may be processed through a printer, such as a laser printer, thermal or inkjet printer to print patient specific indicia on at least the identification panel 26 of each identification band 20 and on the identification card 32. Patient specific indicia also may be printed on portions of the top surface 36 of the face sheet 12 defining the flap 28.

The identification band 20 is used by flexing the laminating sheet assembly 10 near the identification band 20 to sever either the strap 24 or the identification panel 26 from peripheral regions of the face sheet 12 outside of the die cut array 22. As a result, the face sheet 12 will sever along the die cut array 22. The identification panel 26 and the flap 28 can be peeled easily from the backing sheet 14 due to the release coating 42 applied to portions of the top surface 40 of the backing sheet 14 registered with the identification panel 26 and the flap 28. The healthcare worker then continues to pull the identification panel 26, as shown in FIG. 3, to sever the strap 24 from remaining areas of the face sheet 12 and to peel the strap 24 from the backing sheet 14. The die cut array 22 permits clean severance of the strap 24 without excessive force or tearing. Additionally, portions of the bottom surface 38 of the face sheet 12 corresponding to the strap 24 have no adhesive thereon, and the low tack adhesive regions 44 will not significantly impede the intentional peeling of the strap 24 from the backing sheet 14.

The completely separated identification band 20 can be wrapped around the wrist or ankle of the patient and a portion of the top surface 36 along the strap 24 is placed in face-to-face engagement with a portion of the back surface 38 defining the identification panel 26. The adhesive on the back surface 38 of the identification panel 26 will retain the adjacent area of the strap 24 in face-to-face engagement with the identification panel 26. This positioning is carried out to ensure that the identification band 20 does not inadvertently slide off the wrist or ankle, while avoiding a tight constricting fit. Mounting is completed by rotating the flap 28 about the connection line 30 and tucking the flap 28 under the identification panel 26. The connection line 30 is shorter than the longitudinal dimensions of the identically configured identification panel 26 and flap 28. The flap 28 then is secured in face-to-face registration with the back surface 38 of the identification panel 26. Hence, the strap 24 is sandwiched securely between the identification panel 26 and the flap 28. Any excess of the strap 24 that may extend beyond the identification panel 26 can be trimmed.

Figure 6:
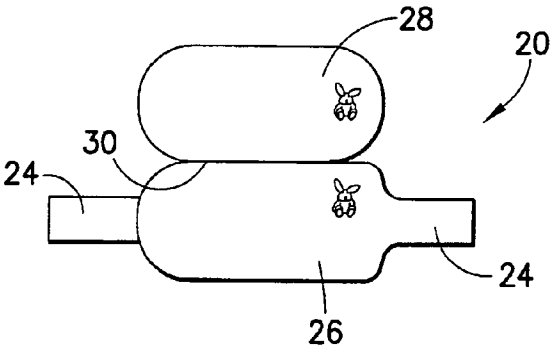
FIG. 6 is a top plan view of the identification band after being formed into a loop but prior to being placed in its final condition.
Figure 7:
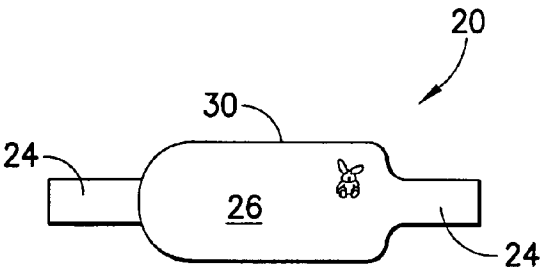
FIG. 7 is a top plan view of the identification band in one possible final condition.
Figure 8:
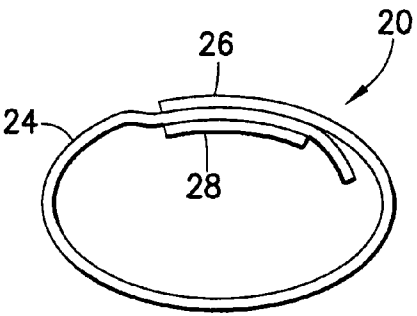
FIG. 8 is a front elevational view of the identification band shown in FIG. 7.
Figure 9:
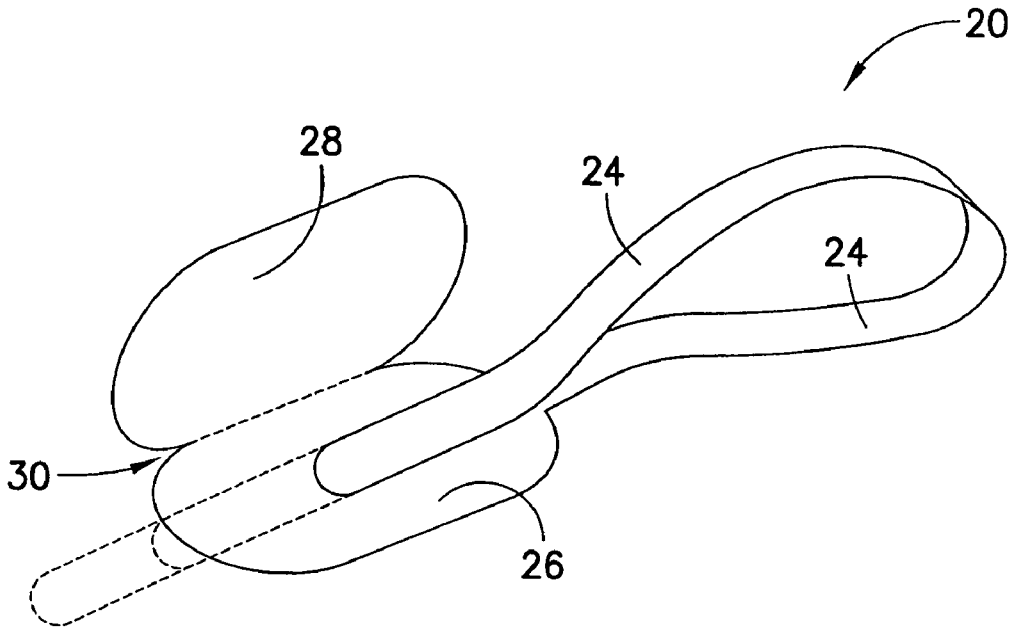
FIG. 9 is a perspective view of the identification band showing another possible orientation for placement on a patient.
Figure 10:
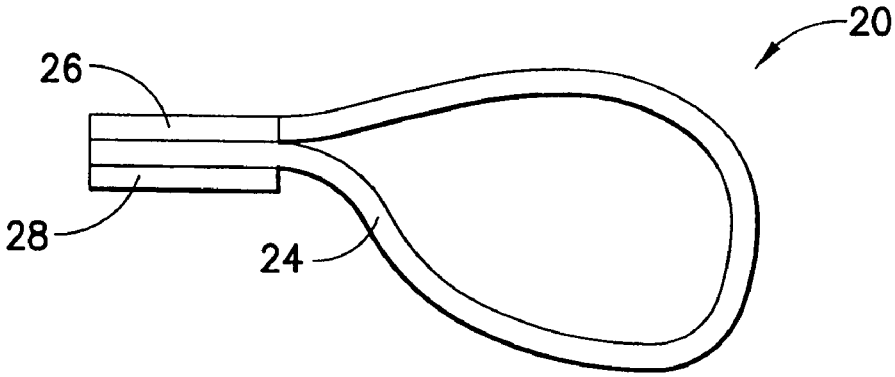
FIG. 10 is a front elevational view of the identification band of FIG. 9 in its fully assembled condition.

The identification band shown in FIGS. 6-8 will generally resemble a wristwatch or watchband. However, the identification band 20 can be mounted on the patient so that the identification band 20 can be mounted on the patient so that the identification panel 26 and the flap 28 define a flag as shown in FIGS. 9 and 10. In this regard, the back surface 38 adjacent the free end of the strap 24 is placed on the back surface of the identification panel 26. The flap 28 then is rotated about the connection line 30 and into secure face-to-face registration with the back surface 38 of the identification panel 26. Thus, the strap 24 is sandwiched securely between the identification panel 26 and the flap 28. However, the identification panel 26 and the flap 28 project transversely from the wrist or ankle of the patient in much the same manner as a flag. The flag arrangement of the identification panel 26 and the flap 28 is easier to achieve and can be easier to read in many situations.

The identification band 20 is soft and flexible to avoid irritating the skin of a patient, such as a prematurely born infant who may require monitoring, nourishment and treatment for an extended time in the healthcare facility. However, the soft flexible woven identification band 20 exhibits excellent strength and is not likely to tear in response to forces exerted during normal usage. The strap 24 is sufficiently wide to lie in face-to-face engagement with the skin of the patient without twisting. The identification panel 26 is sufficiently large to bear all required indicia. Furthermore, the synthetic woven material of the identification band 20 will retain the printed indicia applied thereto despite exposure to fluid and/or contact.

Figure 11:
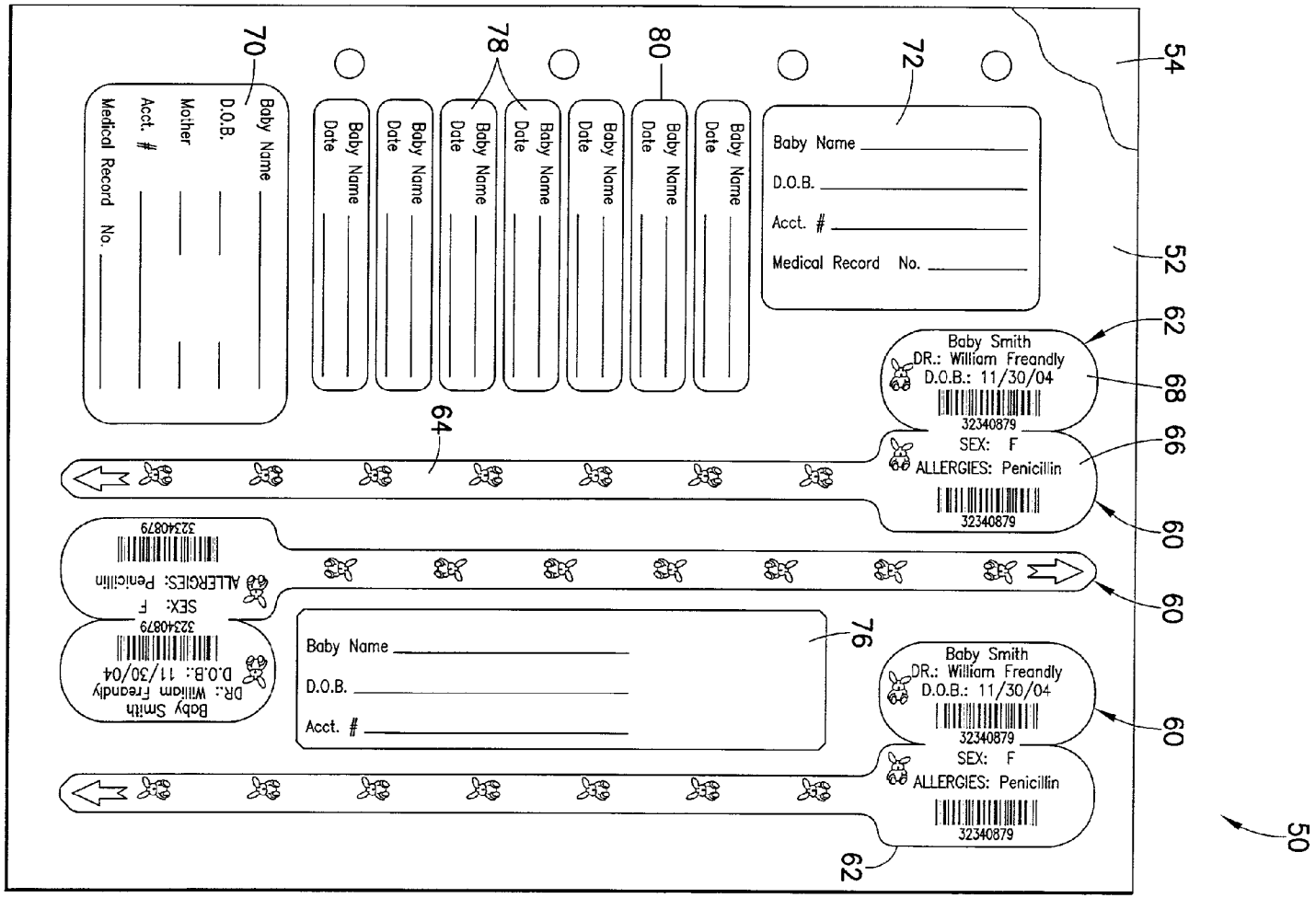
FIG. 11 is a top plan view of a laminated sheet assembly in accordance with a second embodiment of the invention.

The sheet assembly 10 shown in FIGS. 1-3 is only one of many optional sheet configurations. An alternate sheet assembly is identified generally by the numeral 50 in FIG. 11. The sheet assembly 50 includes a face sheet 52 and a backing sheet 54. The sheet assembly 50 includes a plurality of identification bands 60 that are substantially identical to the identification bands 20 described and illustrated with respect to FIGS. 1-8. Thus, each of the identification bands 60 is defined by a die cut array 62 to form a strap 64, an identification panel 66 and a flap 68. The portion of the back surface of the face sheet 52 aligned with the strap 64 have no coating thereon. However, the remainder of the back surface of the face sheet 52 is coated with the above-described pressure sensitive adhesive. Portions of the top surface of the backing sheet 54 registered with the identification panel 66 and the flap 68 have a release coating applied thereto. Portions of the backing sheet 54 aligned with the strap 64 have a low tack adhesive applied thereto.

The sheet assembly 50 differs from the sheet assembly 10 by including a plurality of separate identification cards 70, 72 and 76. In this embodiment, the identification card 70 is configured for insertion into a slot-like receptacle on an isolette. The identification cards 72 and 76 are dimensioned and configured for insertion respectively into pockets formed in a binder cover and a binder spine. The binder then can be used to retain records for a particular patient. As in the first embodiment, portions of the backing sheet 54 registered with the identification cards 70, 72 and 76 have no release coating and no low tack adhesive applied thereto. Hence, the face sheet 52 and the backing sheet 54 permanently adhere to one another across the identification cards 70, 72 and 76. Additionally, substantially registered die cut arrays extend through both the face sheet 52 and the backing sheet 54 around the respective peripheries of the identification cards 70, 72 and 76. Thus, each identification cards 70, 72 and 76 can be separated from the sheet assembly 50 with the backing sheet 54 secured to the face sheet to provide adequate support for the identification cards 70, 72 and 76.

The sheet assembly 50 also differs from the sheet assembly 10 by providing a plurality of labels 78. The labels 78 are imprinted with identification indicia to identify, for example, the patient and the date. Each label 78 is defined by a continuous array of die cuts 80 with dimensions comparable to the die cut arrays 22 of the first embodiment. Thus, each label 78 can be severed from the remainder of the face sheet 52. Portions of the back surface of the face sheet 52 corresponding to each label 78 have a coating of the pressure sensitive adhesive thereon. Portions of the top surface of the backing sheet 54 registered with the respective label 78 have a release coating applied thereto substantially identical to the release coating registered with the identification panels and flaps 66 and 68. Thus, the labels can be separated from the remainder of the sheet assembly 10 and applied to a substrate, such as a bottle of milk or formula.

Figure 12:
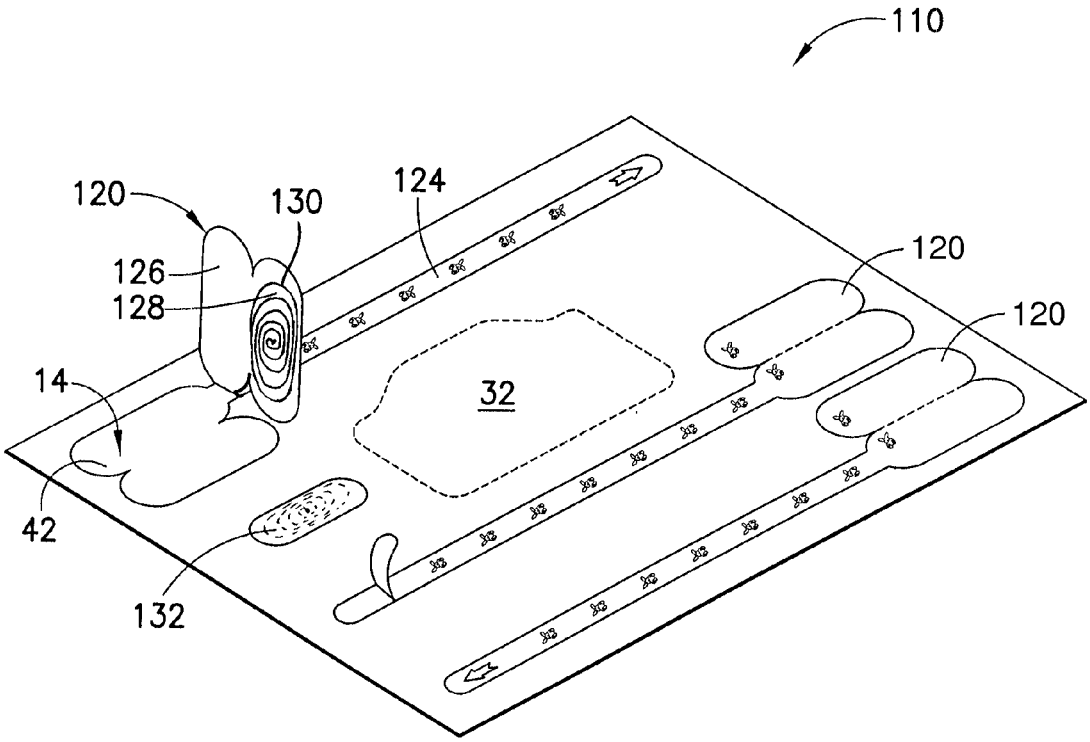
FIG. 12 is a perspective view of a sheet assembly showing an alternate identification band in the process of being removed.
Figure 13:
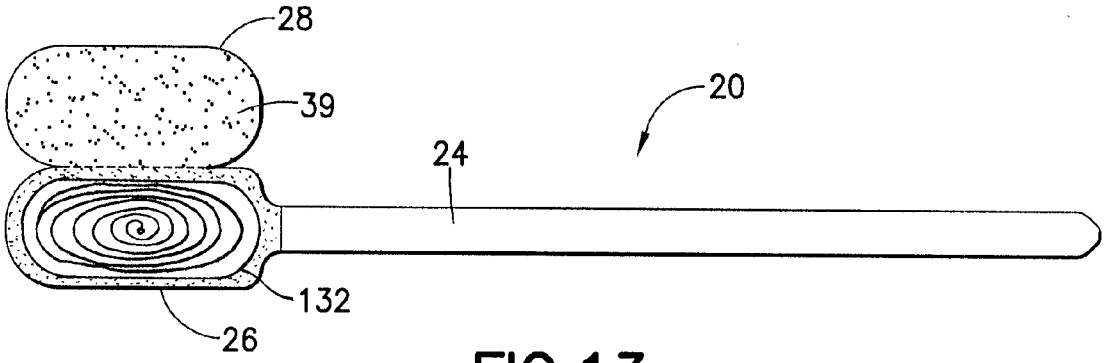
FIG. 13 is a bottom plan view of a further alternate identification band in the planar orientation.

An alternate sheet assembly is illustrated in FIG. 12 and is identified generally by the numeral 110. The sheet assembly 110 is substantially identical to the sheet assembly 10 described and illustrated above. In particular, the sheet assembly 110 includes identification bands 120 each of which has a strap 124, an identification panel 126 and a flap 128. Additionally, an RFID inlay 130 is adhered to the flap 128. As an alternate, the RFID inlay 130 could be secured to the identification panel 126. With either of these options, the identification band will have the RFID inlay 130 secured between the identification panel 126 and the flap 128 as the band is being mounted on the patient. FIG. 12 also shows an RFID label 132. The RFID label 132 could be applied between the identification panel 26 and the flap 28, as shown in FIG. 13. Alternatively, the RFID label 132 could be applied to the exterior of the identification panel 26 or the flap 28 so that the electronic aspects of the RFID label 132 are beneath the portion of the RFID label 132 defined by the face sheet 12. In all of these embodiments, the RFID inlay 130 or the electronic aspect of the RFID label 132 is safely, securely and permanently contained within the identification band 20 or 120. These optional designs permit secure tracking and monitoring of a patient as the patient moves through a healthcare facility. Additionally, the compressible nature of the woven fabric from which the identification band 20, 120 is formed provides a protective cushion around the RFID inlay 130 or label 132. Furthermore, the fabric of the identification band 20, 120 contributes to waterproofing of the RFID inlay 130 or label 132.

While the invention has been described with respect to a preferred embodiment, it is apparent that changes can be made without departing from the scope of the invention as defined by the appended claims. For example, the laminated sheet assembly can have only one identification band or more than the three identification bands illustrated herein. Additionally the illustrated identification card may not be required in all embodiments. Alternatively labels may or may not be included in the laminated sheet assembly. Labels can be provided for application to files, vials or other structures. For these situations, a release coating may be applied to the top surface of the backing sheet at locations registered with the labels. The labels may be defined by die cut arrays and may have adhesive coating applied to the rear surface of the face sheet. Thus, labels can be peeled from the backing sheet and separated from one another and from remaining portions of the face sheet for application to appropriate supports. The embodiments described and illustrated above are intended primarily for use with infants. The invention, however, is particularly well suited for geriatric and other adult applications. In these situations, the identification band may be longer and wider. Still further, the identification panel and the flap may be formed separately from the strap and may function effectively as a fabric clasp for holding opposed portions of the strap in face-to-face relationship to one another. This is particularly well suited for embodiments of the identification band mounted in the form of a flag.

What is claimed is:

1. A laminated sheet assembly having a backing sheet with opposite top and back surfaces and a face sheet with opposite top and back surfaces, the face sheet and the backing sheet being disposed so that the back surface of the face sheet opposes the top surface of the backing sheet, the face sheet being formed from a woven fabric and being formed with at least one array of die cuts defining an elongated strap, an identification panel at one end of the strap and a flap connected to the identification panel, the back surface of the face sheet having a pressure sensitive adhesive applied to at least portions corresponding to the identification panel and the flap, the back surface of the face sheet corresponding to the strap being free of adhesive, the top surface of the backing sheet having a release coating applied to surface areas registered with the identification panel and the flap, the top surface of the backing sheet having a low tack adhesive applied to at least portions thereof registered with the strap.

2. The laminated sheet assembly of claim 1, wherein the top surface of the face sheet has a finish suitable for substantially permanent reception of printed indicia thereon.

3. The laminated sheet assembly of claim 1, further comprising an array of die cuts formed in the face sheet for defining an identification card, portions of the back surface of the face sheet corresponding to the identification card having an adhesive applied thereto, portions of the backing sheet having an array of die cuts formed thereon for substantial registration with the die cuts defining the identification card.

4. The laminated sheet assembly of claim 1, further comprising at least one array of die cuts formed in the face sheet for defining a label, portions of the back surface of the face sheet corresponding to the label having an adhesive applied thereto, portions of the top surface of the backing sheet registered with the label having a release coating applied thereto.

5. The laminated sheet assembly of claim 1, wherein:

a. the elongated strap has opposing first and second ends that are spaced apart along a longitudinal direction;

b. the identification panel is coupled to the second end of the elongated strap;

c. the identification panel extends longitudinally beyond the second end of the elongated strap;

d. the elongated strap has a first length that extends along the longitudinal direction;

e. the identification panel has a second length that extends along the longitudinal direction; and f. the first length is greater than the second length.

6. The laminated sheet assembly of claim 5, wherein:

a. the flap is offset from the identification panel in a direction that is transverse to the longitudinal direction;

b. the elongated strap has a first width that extends along the transverse direction;

c. the identification panel has a second width that extends along the transverse direction; and d. the first width is less than the second width.

7. The laminated sheet assembly of claim 1, wherein the identification panel and the flap have the same approximate size and approximate shape.

8. The laminated sheet assembly of claim 1, wherein the elongated strap and the flap each extend unitarily from the identification panel.

9. The laminated sheet assembly of claim 1, wherein the identification panel includes a surface, and the laminated sheet further comprises indicia imprinted on the surface of the identification panel.

10. The laminated sheet assembly of claim 1, wherein the flap includes a surface, and the laminated sheet further comprises indicia imprinted on the surface of the flap.

11. The laminated sheet assembly of claim 1, wherein the woven fabric is selected from the group consisting of polyester and nylon.

12. The laminated sheet assembly of claim 1, wherein the woven fabric has a thickness between approximately 3.0 mils and approximately 6.0 mils.

13. The laminated sheet assembly of claim 1, wherein the elongated strap has a width between approximately 0.75 cm and approximately 2.25 cm.

14. The laminated sheet assembly of claim 1, wherein the identification panel has a width between approximately 2 cm and approximately 3 cm, and a length between approximately 3 cm and approximately 8 cm.

15. The laminated sheet assembly of claim 1, further comprising a signal generating device that is coupled to an item selected from the group consisting of the identification panel and the flap.

16. The laminated sheet assembly of claim 15, wherein the signal generating device is selected from the group consisting of an RFID inlay and an RFID label.

17. A laminated sheet assembly comprising:

a. a backing sheet having opposite top and back surfaces; and b. a face sheet formed from a woven fabric and having opposite top and back surfaces;

c. wherein:

i. the back surface of the face sheet opposes the top surface of the backing sheet, and ii. the face sheet includes die cuts that define the following in the face sheet:

A. an elongated strap having opposing ends,

B. an identification panel that is coupled to one of the opposing ends of the elongated strap, and C. a flap that is coupled to the identification panel, D. wherein a pressure sensitive adhesive is applied to portions of the back surface of the face sheet that correspond to the identification panel and the flap.

18. The laminated sheet of claim 17, wherein portions of the back surface of the face sheet that correspond to the elongated strap are free of adhesive.

19. The laminated sheet of claim 17, further comprising a release coating that is applied to portions of the top surface of the backing sheet that register with the identification panel and the flap.

20. The laminated sheet of claim 17, further comprising a low tack adhesive that is applied to portions of the top surface of the backing sheet that register with the elongated strap.

21. The laminated sheet of claim 17, further comprising a signal generating device that is coupled to an item selected from the group consisting of the identification panel and the flap.

22. The laminated sheet of claim 21, wherein the signal generating device is selected from the group consisting of an RFID inlay and an RFID label.

* * * * *